United States Patent [19]

Siak et al.

[11] Patent Number: 5,014,774

[45] Date of Patent: May 14, 1991

[54] BIOCIDAL COATED AIR CONDITIONING EVAPORATOR

[75] Inventors: June-sang Siak; Otto J. Klingenmaier, both of Warren, Mich.

[73] Assignee: General Motors Corporation, Detroit, Mich.

[21] Appl. No.: 360,681

[22] Filed: Jun. 2, 1989

[51] Int. Cl.[5] ..... F28F 13/18; F28F 19/06

[52] U.S. Cl. ..... 165/133; 165/134.1; 165/905

[58] Field of Search ..... 165/133, 134.1, 905

[56] References Cited

U.S. PATENT DOCUMENTS

| | | | |
|---|---|---|---|
| 3,053,511 | 9/1962 | Godfrey | 165/133 |
| 3,809,155 | 5/1974 | Anthony et al. | 165/133 |
| 3,960,208 | 6/1976 | Anthony et al. | 165/133 |
| 4,209,059 | 6/1980 | Anthony et al. | 165/134.1 |
| 4,368,776 | 1/1983 | Negita et al. | 165/180 |
| 4,375,991 | 3/1983 | Sachs et al. | 165/95 |
| 4,412,869 | 11/1983 | Vernam et al. | 165/905 |
| 4,531,980 | 7/1985 | Miura et al. | 165/905 |
| 4,615,952 | 10/1986 | Knoll | 165/133 |
| 4,631,135 | 12/1986 | Duddridge et al. | 165/134.1 |
| 4,674,566 | 6/1987 | Heine et al. | 165/134.1 |

OTHER PUBLICATIONS

Lowenheim, F. A., ed., *Modern Electroplating, Third Edition,* John Wiley & Sons, Inc., New York (1974), pp. 593–595 and pp. 734–739.

American Society for Metals, *Metals Handbook, Ninth Edition,* vol. 5, Surface Cleaning, Finishing, and Coating (1982), pp. 601–606.

U.S. Ser. No. 172,167, Wolf, filed Mar. 23, 1988.

*Primary Examiner*—John Rivell
*Assistant Examiner*—L. R. Leo
*Attorney, Agent, or Firm*—Douglas D. Fekete

[57] ABSTRACT

An automotive air conditioning system evaporator core is formed of an aluminum alloy and has a biocidal coating comprising a zinc layer deposited onto said aluminum alloy and an outermost elemental copper plate overlying said zinc layer. During air cooling operations, slightly acidic condensate accumulating on the surface reacts with the copper to form cupric ions that inhibit microbial growth.

2 Claims, 1 Drawing Sheet

BIOCIDAL COATED AIR CONDITIONING EVAPORATOR

BACKGROUND OF THE INVENTION

This invention relates to an aluminum evaporator core for an automotive air conditioning system and, more particularly, to such core having a metallic copper coating to inhibit microbial growth.

A typical automotive air conditioning system comprises an evaporator core located at the front of the passenger compartment for cooling an air stream entering the compartment from outside the vehicle or circulated from the compartment. The evaporator is generally formed of an aluminum alloy not only because of the high thermal transfer properties that accelerate air cooling, but also because sheets of such alloy are readily formed by stamping and brazing to manufacture the evaporator. As the air cools, moisture tends to condense onto exterior surfaces of the evaporator. This moist environment promotes the growth of bacteria or fungi and, if such growth becomes excessive, may produce an unpleasant odor or other condition that adversely affects passenger comfort.

Cupric salts are known to be effective fungicides and bactericides. Common cupric salts are water soluble so that a mere application of such salt to an evaporator would wash away with the voluminous condensate that drains from the core and thus be effective for only a brief time. Rather, it is desired to inhibit microbial growth over an extended time suitable for automotive components.

It is an object of this invention to provide an evaporator core formed of an aluminum alloy to take advantage of its high heat transfer properties and ready formability, and having a coating which generates cupric ions effective to inhibit microbial growth and continues to generate such cupric ions over an extended period of time such as is required for automotive use.

SUMMARY OF THE INVENTION

This and other objects are accomplished by an automotive evaporator core formed of an aluminum alloy and having a biocidal metallic copper coating. A preferred coating comprises a first, zinc film deposited onto the aluminum substrate and an outermost metallic copper plate overlying the zinc layer. The zinc layer, which is preferably formed by immersion in a zincate solution, facilitates immersion deposition of copper and also promotes adhesion of the copper plate. The presence of zinc metal may also protect the underlying aluminum from corrosion.

Within the automotive environment, condensate on the core reacts with the exposed copper metal to generate the desired biocidal cupric ions. This reaction is enhanced by slight acidification of the condensate that results from dissolution of airborne acidic species or by acidic organic microbial byproducts. In any event, it is found that the copper coating is effective to inhibit microbial growth on the core. Although the resulting cupric salts are flushed away with the drained condensate to prevent buildup on the core, the copper-condensate reaction is sufficiently slow so that a relatively thin copper layer may continue to generate biocidal cupric ions over an extended time of several years suitable for automotive component use.

DESCRIPTION OF THE DRAWINGS

The present invention will be further illustrated with reference to the accompanying figures wherein.

DETAILED DESCRIPTION OF THE INVENTION

Figure 1:
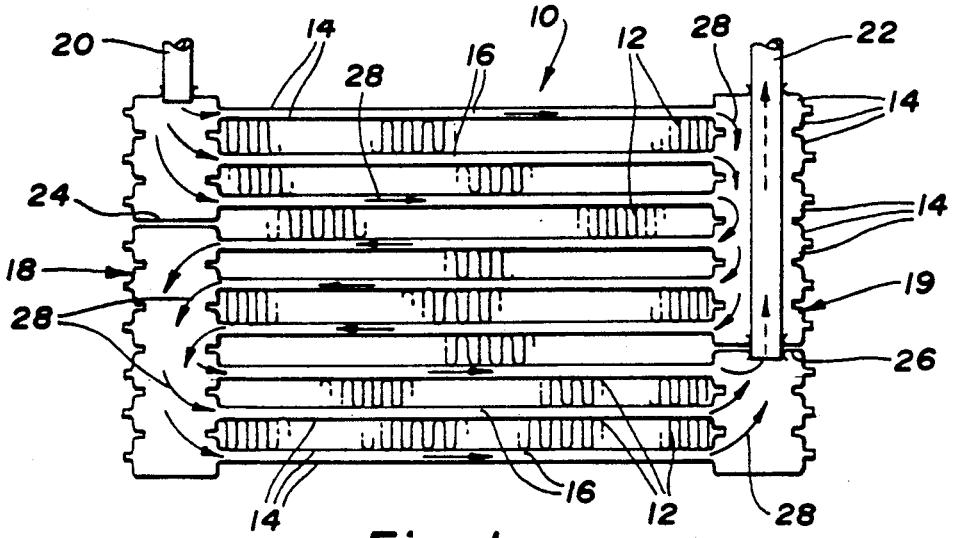
FIG. 1 is a front elevational schematic view of an automotive air conditioning evaporator core of the kind improved by the present invention.
Figure 2:
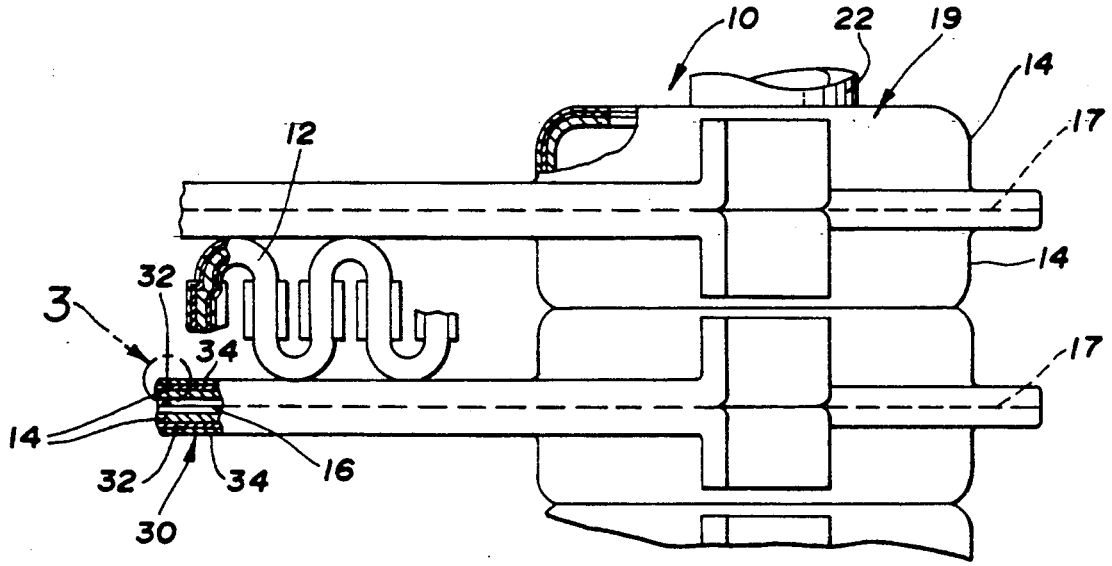
FIG. 2 is a cross sectional view of a portion of the evaporator core of FIG. 1.

Referring to the figures, a motor vehicle air conditioning system evaporator 10 comprises convoluted, louvered, metal fins 12 interposed between pairs of stamped sheet metal plates 14. The fins and plates are formed of an aluminum alloy having high thermal transfer properties. The fins and plates are individually stamped from sheet stock and assembled into the desired arrangement, whereafter the fins and plates are brazed or soldered into an integral structure. More particularly, plates 14 are hermetically sealed by perimetric joints 17 to define a plurality of parallel passes 16 and end manifolds 18 and 19 in interconnecting relationship. An inlet tube 20 is connected to manifold 18 for introducing refrigerant in a cooled state into evaporator 10. Evaporator 10 further comprises an outlet tube 22 connected through a manifold 19 for withdrawing spent refrigerant. Baffles 24 and 26 are strategically located in manifolds 18 and 19 for directing refrigerant flow through evaporator 10 along a tortuous path indicated by arrows 28. During air conditioning operation, refrigerant flowing through passes 16 cools air blowing through the interplate passages. This heat transfer is facilitated by fins 12 that increase gas-surface contact. The evaporator is of a conventional fin-and-plate design like that disclosed in U.S. Pat. No. 4,470,455, assigned to the assignee of this invention and hereby incorporated by reference.

According to a preferred embodiment of this invention, the exterior surface of evaporator 10 carries a dual-plate coating 30 comprising a first zinc layer 32 immediately overlying the aluminum alloy substrate and an outer elemental copper layer 34 overlying the zinc layer. The coating is applied to the integral structure after assembling and brazing the several plates and fins. The structure is cleaned by immersion in a mild acidic aqueous solution at 50° C. and ultrasonically cleaned for 30 seconds, followed by rinsing in deionized water. The clean structure is then immersed in a zincate solution at 25° C. A preferred zincate solution is prepared by dissolving in water about 12 g/L zinc oxide, ZnO; 75 g/L sodium hydroxide, NaOH; 7.5 g/L sodium cyanide, NaCN; 50 g/L sodium tartrate dihydrate, $Na_2C_4O_6.2H_2O$; 1.7 g/L nickel sulfate hexahydrate, $NiSo_4.6H_2O$; 5 g/L copper sulfate pentahydrate, $CuSO_4.5H_2O$; and 2 g/L ferric chloride hexahydrate, $FeCl_3.6H_2O$. During immersion, a zinc plate on the order of about 0.55 microns thick was deposited on the clean aluminum surface by a chemical replacement reaction wherein aluminum is dissolved into the solution. The zinc-plated structure was rinsed in deionized water and then immersed for 45 seconds in an aqueous immersion copper-plating solution at 25° C. A preferred copper solution is formed by dissolving in water about 7.5 g/L copper sulfate pentahydrate, $CuSO_4.5H_2O$; 15 g/L sodium tartrate dihydrate, $Na_2C_4H_4O_6.2H_2O$; 7 g/L sodium hydroxide, NaOH; and about 1 g/L of a nonionic surfactant commercially available from Union Carbide Company under the trade designation Tergitol NPX. During immersion, copper plates onto the core surface by a replacement electrolytic deposition process wherein a portion of the zinc layer is dissolved into the solution, reducing the thickness of the zinc plate. The resulting copper plate was about 0.129 micron thick. The dual plated structure is then rinsed in deionized water and dried using forced warm air.

Figure 3:
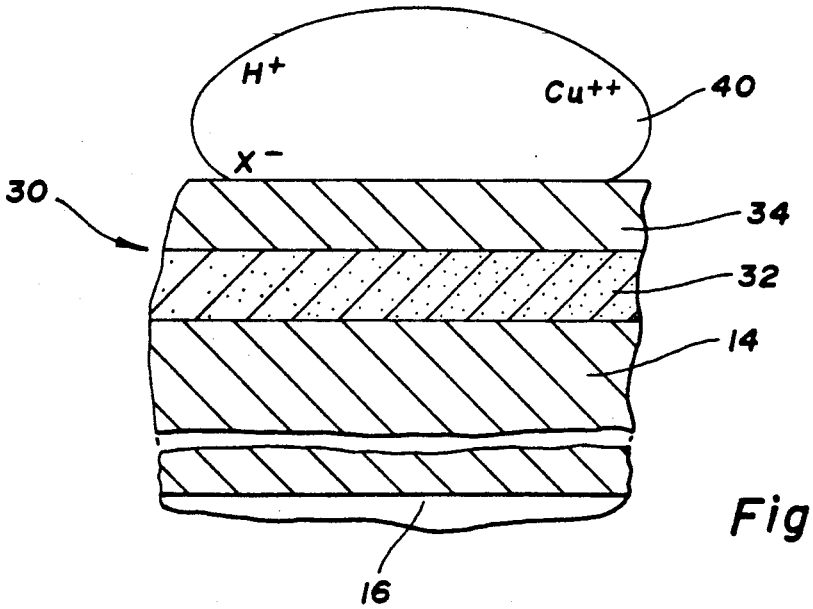
FIG. 3 is an enlarged cross sectional view of a portion of the biocidal coating of this invention on the evaporator core of FIGS. 1 and 2.

During air conditioning operation, moisture in the air cooled by evaporator 10 condenses onto the exterior coated surfaces thereof. While not limited to any particular theory, it is believed that acidic species may dissolve into the condensate, forming a dilute acidic solution. Referring to FIG. 3, there is shown a water bead 40 condensed on the surface of evaporator plate 14 and containing hydrogen ions $H+$ in combination with cations $X^-$. The cations may include airborne species such as sulfates, nitrogen oxides and sulfur dioxides, or organic species such as acetate, succinate and citrate produced by microbial growth on the evaporator surfaces. In any event, it is believed that hydrogen ions react with elemental copper to form cupric ions, $Cu++$, which cupric ions are in turn effective to inhibit growth of odor-producing fungi and bacteria on the evaporator surface. Eventually, cupric salts are removed in condensate drained from the surface to prevent buildup on the evaporator core. Thereafter, fresh condensate collecting on the copper layer produces additional biocidal cupric ions. The attack of the copper plate by the dilute acid is sufficiently slow to allow cupric ions to be generated in this manner over an extended time.

The preferred dual coating comprises a zinc layer intermediate the aluminum substrate and the exposed copper plate. The zinc promotes bonding of the copper on the aluminum alloy substrate. In addition, a portion of the zinc layer is consumed in the preferred immersion copper plating process. The intermediate zinc may also provide a sacrificial barrier to protect the underlying aluminum from corrosion that might otherwise be accelerated by the proximity to copper. The zincate process involves dissolution of aluminum from the surface and reduction of zinc from solution. Deposition is generally limited to the formation of a continuous zinc layer adequate to prevent further aluminum dissolution. Typically, zinc layers up to about 0.6 microns are formed by the bath of the type in the described embodiment and provide a suitable surface for the deposition of copper.

In the described embodiment, the copper layer was formed by chemical replacement reaction wherein zinc on the surface is dissolved into the bath with the concurrent reduction and deposition of copper. Immersion copper deposition is self-limited by the formation of a continuous copper plate sufficient to prevent further zinc dissolution. In general, copper plates up to about 0.14 micron are produced over zinc coatings by a process of the type in the described embodiment. Suitable copper plates may be applied by other electroless or electroplating processes, either directly onto the zinc layer or following immersion copper deposition. The thickness of the copper plate may be increased to further extend the biocidal effect of the coating of this invention. While the biocidal coating of this invention may be suitably applied to a selected region of an evaporator core or to evaporator component surfaces prior to assembly or brazing, it is preferred to apply the coating to the brazed structure to avoid interference with the brazing operation and to minimize simultaneous contact by the condensate between the copper plate and unprotected aluminum which might otherwise result in accelerated corrosion of the aluminum. Also, the coating of this invention is suitable for nonautomotive air conditioning evaporator cores, such as used for buildings, to inhibit microbial growth and there improve treated air quality.

While this invention has been disclosed principally in terms of a particular embodiment, it is not intended to be limited to that embodiment, but rather only to the extent set forth in the following claims.

The embodiments of the invention in which an exclusive property or privilege is claimed are defined as follows:

1. An air conditioning system evaporator core formed of an aluminum alloy and having an exterior surface whereon aqueous condensate tends to accumulate during air cooling operations, said evaporator core having a coating applied to said surface substantially coextensive with it, said coating being adherent to said surface and thus adapted for extended time utility for inhibiting microbial growth in the aqueous condensate environment on said surface, said coating comprising a zinc layer deposited immediately onto said aluminum alloy and an outermost elemental copper plate overlying said zinc layer and suitable for reaction with said condensate to form cupric ions that are effective to inhibit microbial growth on said core.

2. An air conditioning system evaporator core having convoluted, louvered metal fins interposed between circumferentially brazed pairs of plates that define passes for conveying refrigerant during air conditioning operations, said plates and fins being formed of an aluminum alloy, said core having an exterior surface whereon aqueous condensate tends to accumulate during air cooling operations and carrying a coating substantially coextensive with it, said coating being adherent to said surface and thus adapted for extended time utility for inhibiting microbial growth in the aqueous condensate environment on said surface, said coating comprising a zinc layer deposited immediately onto said aluminum alloy and an outermost elemental copper layer overlying said zinc layer and suitable for reaction with said condensate to form cupric ions that are effective to inhibit microbial growth on said core.

* * * * *